United States Patent [19]

Bell

[11] 4,450,634

[45] May 29, 1984

[54] BOOTS WITH QUICK RELEASE MEANS

[76] Inventor: Michael Bell, 1705 Triumphe Way, Warrington, Pa. 18976

[21] Appl. No.: 433,572

[22] Filed: Oct. 12, 1982

[51] Int. Cl.[3] ..... A43B 11/00

[52] U.S. Cl. ..... 36/138; 223/113

[58] Field of Search ..... 36/1, 138; 223/113

[56] References Cited

U.S. PATENT DOCUMENTS

| | | | |
|---|---|---|---|
| 45,776 | 1/1865 | Watson | 36/138 |
| 1,165,812 | 12/1915 | Staubly | 36/138 |
| 3,621,592 | 11/1971 | Goldmerstein | 36/138 |

*Primary Examiner*—Patrick D. Lawson

*Attorney, Agent, or Firm*—Caesar, Rivise, Bernstein & Cohen, Ltd.

[57] ABSTRACT

Quick release means for a pair of footwear. The quick release means enables one to readily extract one's feet from the footwear without the use of one's hands. In that regard, each footwear of the pair includes a notch in the toe portion of the outsole and a projection extending generally upwardly from the heel portion. The removal of the footwear is accomplished when one positions his or her feet so that a portion of the outsole of one of said pair of footwear overlies the projection of the other of said pair, with the notch receiving the projection, therein. This enables the wearer to readily extract one of his or her feet from one of the footwear. Obviously, to extract both feet, the first foot is only partially extracted from the footwear initially selected for removal, enabling that same footwear to then be used to extract the other foot from its footwear.

15 Claims, 4 Drawing Figures

BOOTS WITH QUICK RELEASE MEANS

BACKGROUND OF THE INVENTION

This invention relates generally to footwear and more particularly to industrial type footwear.

Removal of prior art footwear, from one's foot, generally requires the wearer thereof to reach down with one or both hands in order to manually pull the footwear from that foot.

It has been found, however, that many people remove their shoes or boots by pressing down on the heel of one shoe or boot with the toe of the other and then pulling their foot at least partially out of the shoe or boot which is being held down. This process is then repeated using either the partially removed shoe or boot or the bare foot in order to remove the second shoe or boot from the person's other foot.

Although this method of removing one's footwear can readily be accomplished when wearing conventional moccasin type of footwear, it becomes somewhat more difficult, if not nearly impossible in situations where various bulkier types of boots (e.g., vinyl or rubber overboots) or work shoes are being worn. Furthermore, the above mentioned method of removing footwear is particularly difficult where the boot includes a relatively high upper as is the case with boots, whether primary boots or overboots.

In an effort to facilitate the removal of boots as above described, various prior art boots have been constructed having a kick plate extending outwardly from the heel of the boot. The kick plate is a generally flat extension from the heel extending parallel to the ground, and arranged to be stepped upon by the other boot to facilitate the boot's removal.

Although the use of a kick plate is likely to enhance the ease with which a person is able to remove his or her boots by the method described above, this means and method of removing footwear can certainly be improved upon by using footwear specially constructed to facilitate their removal as such.

OBJECTS OF THE INVENTION

Accordingly, it is a general object of the invention to provide quick release boots which overcome the disadvantages inherent in prior art boots.

It is a further object of the invention to provide quick release boots which include means to facilitate the removal of the boots from the wearer's feet, without the necessity of the wearer using his or her hands.

It is still a further object of the invention to provide boots which are readily removed from one's feet without manual assistance, yet are simple in construction, inexpensive to produce and can readily be designed to have a generally conventional and/or stylish appearance.

SUMMARY OF THE INVENTION

These and other objects of the instant invention are achieved by providing a pair of footwear having quick release means. Each of the footwear of the pair includes an outsole and a heel portion. The quick release means comprises two cooperating members each forming a portion of a respective one of said pair of footwear. One of said members comprises a recess in the outsole of one of said pair and the other of said members comprises a projection from the heel portion of the other of said pair. Each recess is configured to receive the projection of the cooperating member, whereupon the wearer can position his or her feet so that a portion of the outsole of one of said pair of footwear overlies the projection of the other of said pair and with said recess receiving said projection therein, to enable the wearer to readily extract his or her foot from said one of the pair of footwear without manual assistance.

DETAILED DESCRIPTION OF PREFERRED EMBODIMENT

Figure 1:
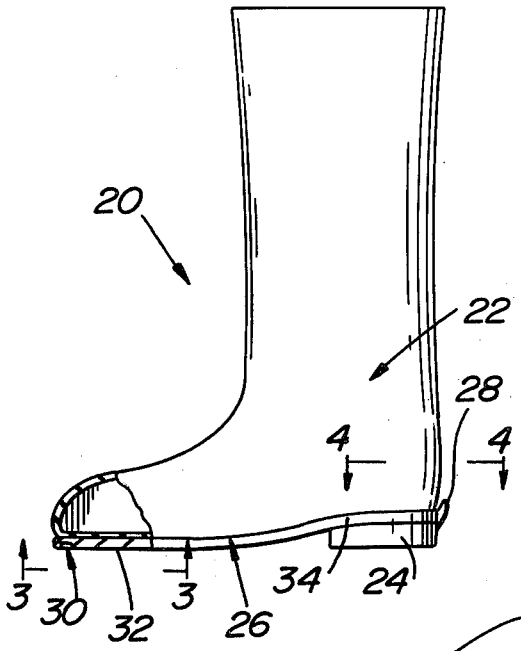
FIG. 1 is a front elevational view, partially in section, of a boot constructed in accordance with this invention.

Referring now to the various figures of the drawing wherein like reference characters refer to like parts there is shown in 20 in FIG. 1 a left boot (i.e., a boot designed to be worn on one's left foot) constructed in accordance with the instant invention. It should be pointed out that the boot shown in FIG. 1 is merely exemplary of any type of footwear which can be constructed in accordance with this invention. To that end, the term "boot" as used hereinafter should be understood to apply equally to a primary boot, an overboot, a shoe, a sneaker, or any other footwear.

Moreover, although only a left boot 20 is shown fully in the drawing, it should be understood that the right boot 21 of this invention is constructed identically to the left boot 20.

The quick release means of the instant invention is made up of a pair of cooperating components. Each boot includes a respective component for cooperation with the component of the other boot to provide an expedient means for removing one's boots from one's feet. Moreover, the quick release means also provides a means of removal of the boots which does not require the wearer to use or otherwise touch the boots with his or her hands. This latter feature is particularly valuable in situations where the wearer's hands are occupied or in situations where the boots are likely to be contaminated (e.g., with toxic chemicals), wet or muddy so as to make physical contact between the boots and one's hands undesirable.

Referring now to FIG. 1, the boot 20 basically comprises a conventional upper 22, a heel 24, an outsole 26, projection means 28 and notch means 30.

The upper 22 is of conventional construction and is connected to the outsole 26 by conventional means. The outsole 26 of the boot includes a toe portion 32 and a heel portion 34. The heel 24 is connected to the heel portion 34 of the outsole 26 by conventional means.

The notch means 30 comprise a pair of recesses in the bottom surface of the outsole 26 of each boot adjacent its forward or toe end (to be described later). The projection means 28 is in the form of a short spur-like element which extends upwardly and outwardly from the heel portion of each boot.

The notch means 30 of the left boot is arranged to receive a portion of the spur 28 of the right boot in order to facilitate the quick removal of the right boot from the wearer's foot. Similarly, the notch means of the right boot is arranged to receive a portion of the spur of the left boot to facilitate the quick removal of the left boot from the wearer's foot.

It should be pointed out that in order to facilitate the removal of both boots using this method, one's foot is only partially removed from the boot initially selected for removal, thus enabling the wearer to use that boot, and more particularly, its notch means 30 to loosen or remove the second boot from his or her other foot, prior to the first boot being completely removed.

Figure 3:
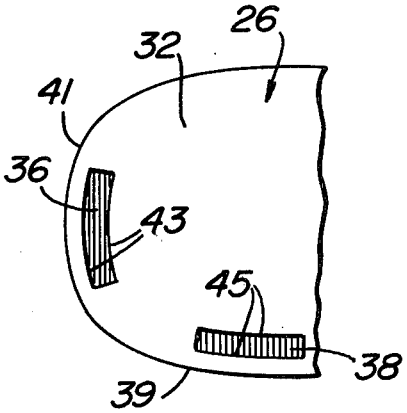
FIG. 3 is an enlarged plan view taken along line 3—3 of FIG. 1.

Referring to FIG. 3, it can be seen that the notch means 30 comprises a frontal notch 36 adjacent the top of the sole and a side notch 38 adjacent the medial (inside) edge of the sole. It should be appreciated that the location of the notches 36 and 38, respectively (as shown in FIG. 3) is for the left boot. Thus, the right boot also has a frontal notch 36 adjacent the top of its sole and a side notch adjacent the medial side of said sole.

Each notch 36 and 38 is constructed as an elongated recess whose depth is sufficiently great to adequately receive a cooperating spur 28 so as to prevent the spur 28 from accidentally pulling free of the notch once it is inserted therein. In the exemplary embodiment shown herein the depth of each notch is approximately one-half the thickness of the outsole 26.

The longitudinal edges 43 and 45 of the respective notches 36 and 38 are slightly arcuate (with the longitudinal edges of the frontal notch 36 being slightly more arcuate than those of the side notch 38), so as to generally conform to the curved periphery of the outsole 26 of the boot adjacent these respective locations.

The peripheral dimensions of the notch 36 is approximately the same as the peripheral dimensions of notch 38. Moreover, the peripheral dimensions of each of these respective notches is somewhat larger than the width of the upper portion of the spur so that the spur may be received therein with a minimal amount of difficulty.

The frontal notch 36 is situated so that its longitudinal axis is generally perpendicular to the longitudinal axis of the outsole 26 while the side notch 38, which is situated adjacent the inside edge 39 of the outsole 26, has a longitudinal axis which is generally parallel to the longitudinal axis of the outsole 26.

The spur 28 is an upwardly and outwardly extending, generally rectangular projection of rigid construction. The spur can be constructed of a variety of different materials. Thus, when the boot is a vinyl or rubber overboot the spur can be of vinyl or rubber, and can be molded integrally with the boot. Reinforcing means, such as a steel plate or rod can be used in the spur, if desired.

The spur 28 (FIG. 2) basically comprises a base portion 42 and a free end or tip 44. The base portion 42 of the spur projects from the back surface 46 of the boot adjacent the interface of the heel 24 and the heel section 34 of the outsole.

Figure 2:
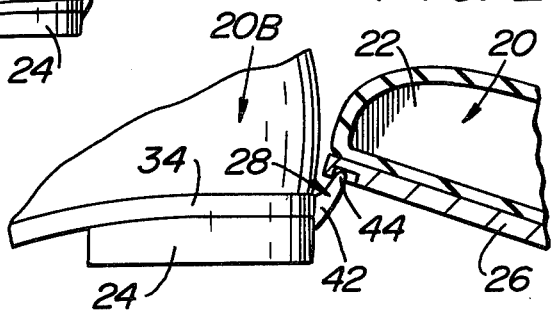
FIG. 2 is an enlarged front elevational view, partially in section of the toe portion of the boot shown in FIG. 1 cooperating with the heel portion of a second boot, to effectuate the removal of the second boot from the wearer's foot.
Figure 4:
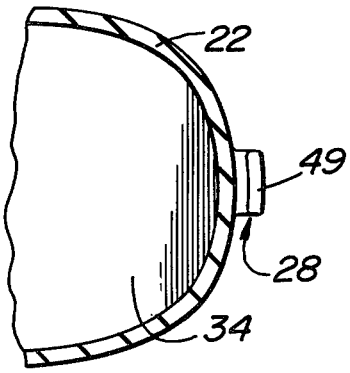
FIG. 4 is an enlarged sectional view taken along line 4—4 of FIG. 1.

The base portion 42 of the spur is generally wedge shaped, i.e., its rear surface extends upwardly and outwardly from the boot at approximately a 60 degree angle (the angle being measured from the plane of the outsole). The upper tip or free end 44 of the spur 28 curves inwardly slightly so as to be generally perpendicular to the outsole and parallel to the boot's upper 22. Moreover, as can be seen in FIGS. 2 and 4, the top surface 49 of the spur is generally rectangularly shaped (although slightly arcuate to generally conform to the peripheral shape of the notches 30) with its peripheral edges being beveled slightly. The beveled edges enable the spur to readily slide into the selected notch 36 or 38, as desired.

Thus, in light of the foregoing discussion and as shown in FIG. 2, it can readily be appreciated that the removal of a pair of boots constructed in accordance with this invention, is readily accomplished as follows:

Using either boot, e.g., the left boot 20, the wearer steps on the spur 28 of the opposite boot, e.g., the right boot 21. The left boot is thus positioned so that its outsole overlies the spur with the spur being located within either the frontal notch 36 or the side notch 38. Whether one selects the frontal notch or the side notch is generally a matter of individual preference, although it has been found that one or the other might tend to work better with various different types of footwear.

The wearer then pulls his right foot partially free from the right boot, leaving enough of his foot remaining in that boot so that the right boot can then be used to repeat this process to remove the left boot.

The partially removed right boot is completely removed from the wearer's right foot by its being kicked off of that foot (e.g., by kicking the heel portion of the partially removed boot against the ground). If the left boot has not already been completely removed, it too is kicked off in the manner just described.

Obviously, this process works equally well when removing the boots in the reverse order, e.g., starting with the left boot.

As should be appreciated from the foregoing discussion, the footwear of this invention 20 provides its wearer with quick release or removal means which do not require the wearer to touch or otherwise use his or her hands in order to remove the footwear. Furthermore, the quick release means is simple and inexpensive in construction and can readily be utilized with a wide variety of different types of footwear.

Without further elaboration, the foregoing will so fully illustrate my invention that others may, be applying current or future knowledge, readily adapt the same for use under various conditions of service.

I claim:

1. In a pair of footwear, wherein each of the footwear of said pair includes an outsole and a heel portion, quick release means which comprises first and second cooperating members, each of said members forming a portion of a respective one of said pair of footwear, said first member comprising a recess in said outsole of one of said pair and said second member comprising a projection from the heel portion of the other of said pair, said recess being configured to receive said projection of the cooperating member, whereupon the wearer of said footwear can position his or her feet so that a portion of the outsole of one of said pair of footwear overlies said projection of the other of said pair, with said recess receiving said projection therein, thus enabling said wearer to readily extract his or her foot from one of said pair of footwear without manual assistance.

2. The footwear of claim 1, wherein each of said pair comprises both a recess and a projection.

3. The footwear of claim 2, wherein each of said recesses is located in the toe portion of the outsole of each respective footwear.

4. The footwear of claim 2, wherein each of said recesses is located adjacent the respective inside edge of the outsole of each respective footwear.

5. The footwear of claim 4, wherein each of said pair further comprises a second recess which is located adjacent the top edge of the toe portion of said outsole.

6. The footwear of claim 2, wherein the periphery of each of said recesses is generally rectangular.

7. The footwear of claim 2, wherein the periphery of each of said recesses is generally rectangular, yet slightly arcuate.

8. The footwear of claim 2, wherein each of said projections extends generally upwardly from said heel portion.

9. The footwear of claim 8, wherein each of said projections extends both outwardly as well as upwardly.

10. The footwear of claim 9, wherein each of said projections includes a top portion which is generally at right angles to said outsole.

11. The footwear of claim 8, wherein each of said projections is of generally rigid construction.

12. The footwear of claim 2, wherein each of said projections is formed integrally with said footwear.

13. The footwear of claim 12, wherein each of said projections is of a generally rigid construction.

14. The footwear of claim 13, wherein said footwear comprises a boot.

15. The footwear of claim 14, wherein said boot is molded.

* * * * *